US005334961A

United States Patent [19]

Shirai et al.

[11] Patent Number: 5,334,961

[45] Date of Patent: Aug. 2, 1994

[54] STRIP-LINE TYPE BANDPASS FILTER

[75] Inventors: Hirokazu Shirai, Kawasaki; Morikazu Sagawa, Tokyo; Mitsuo Makimoto, Yokohama, all of Japan

[73] Assignee: Matsushita Electric Industrial Co., Ltd., Osaka, Japan

[21] Appl. No.: 925,156

[22] Filed: Aug. 6, 1992

[30] Foreign Application Priority Data

Aug. 12, 1991 [JP] Japan ..... 3-201682
Dec. 25, 1991 [JP] Japan ..... 3-342628

[51] Int. Cl.[5] ..... H01P 1/203
[52] U.S. Cl. ..... 333/204; 333/219
[58] Field of Search ..... 333/202-205, 333/219, 246, 235

[56] References Cited

U.S. PATENT DOCUMENTS 2,859,417 11/1958 Arditi ..... 333/204
3,451,015 6/1969 Heath ..... 333/204 X
5,021,757 6/1991 Kobayashi et al. ..... 333/204 X
5,144,268 9/1992 Weidman ..... 333/204

FOREIGN PATENT DOCUMENTS 61-189701 8/1986 Japan .
0001309 1/1989 Japan ..... 333/219
0054901 3/1989 Japan ..... 333/204
0154401 7/1991 Japan ..... 333/204

*Primary Examiner*—Seungsook Ham
*Attorney, Agent, or Firm*—Lowe, Price, LeBlanc & Becker

[57] ABSTRACT

A first bandpass filter comprises: a plurality of resonators and input/output lines formed such that a strip line formed in a substantially straight line is cut in an inclined direction to the straight line to form a plurality of resonators spaced apart by gaps, the resonators being coupled across the gaps. Each of the resonators may be formed in parallelogram. Each of the resonators may be formed in a substantial isosceles triangle. A second bandpass filter comprises: a plurality of resonators and a ground electrode, each of the resonators having an open-end strip line, one end of each of the strip line being connected to the ground electrode, width of each gaps between the resonators varying along the each of resonators to make either of electrostatic or electromagnetic coupling between the resonators stronger than the other.

6 Claims, 4 Drawing Sheets

STRIP-LINE TYPE BANDPASS FILTER

BACKGROUND OF THE INVENTION

1. Field of the Invention

This Invention relates to a bandpass filter having a plurality of resonators formed of strip lines.

2. Description of the Prior Art

A bandpass filter having resonators used in microwave or millimeter wave integrated circuit is known. In such bandpass filter, open-end strip lines are used for such resonator because high frequency grounding is unnecessary and variation in resonating frequency is low. Such resonator employs a uniform strip line because of easiness of design. Coupling at input/output and between those resonators are obtained by electromagnetic coupling at side edges of strip lines and electrostatic coupling at end edges of strip lines.

FIG. 4 is a plan view of such first prior art bandpass filter. Numerals 1, 2, and 3 denote uniform strip line type cascaded resonators. Numerals 4 and 5 denote input/output strip lines for coupling the resonator 1 or 3 to external circuits by electromagnetic coupling.

thereinbelow will be described operation of this prior art bandpass filter.

A high frequency signal inputted from the input/output strip line 4 is coupled to the resonator 1 by distributed coupling through side edges of the input/output strip line 4 and the resonator 1. The resonators 1, 2, and 3 are coupled through side edges and outputs a filtered high frequency signal at the input/output strip line 5 through coupling between the resonator 3 and the input/output strip line 5. Thus, this prior art bandpass filter provides a frequency characteristic determined by the resonance frequencies of the resonators 1, 2, and 8, etc.

FIG. 5 is a plan view of a second prior art bandpass filter using electrostatic coupling between end edges of strip lines. Numerals 6, 7, and 8 are uniform uniform strip line type cascaded resonators. Numerals 9 and 10 are input/output strip lines using electrostatic coupling between ends of strip lines.

Hereinbelow will be described operation of this prior art bandpass filter.

A high frequency signal inputted from the input/output strip line 9 is coupled to the resonator 6 by distributed coupling through end edges of the input/output strip line 9 and the resonator 6. The resonators 6, 7, and 8 are coupled through end edges of strip lines and outputs a filtered high frequency signal at the input/output strip line 10 through coupling between the resonator 8 and the input/output strip line 10. Thus, this prior art bandpass filter provides a frequency characteristic determined by the resonance frequencies of the resonators 6, 7, and 8, and coupling characteristics, etc.

In the above mentioned bandpass filter using magnetic coupling between side edges of strip lines, there is a problem it is impossible to arrange the resonators 1, 2, and 3 and the input/output strip lines 4 and 5 in line. That is, this prior art band pass filter extends two-dimensionally.

In the above mentioned bandpass filter using electrostatic coupling between end edges of strip lines, there is another problem that a total length of the bandpass filter is long because the resonators 6, 7, and 8 and the input-/output strip lines 9 and 10 are arranged in line. Moreover, there is further problem that it is difficult to obtain a broadband characteristic in the bandpass filter using electrostatic coupling between end edges of strip lines because electrostatic coupling between end edges of strip lines cannot provide sufficient degree of coupling.

Moreover, when these bandpass filters are used as an output filter in a non-linear circuit such as an oscillator, amplifier, or the like, there are provided other passbands at frequencies natural number times desired frequency because uniform strip line is used in the resonators. Therefore, there is a problem that it is necessary to use these bandpass filter in combination with other bandpass filter having different frequency characteristic.

Hereinbelow will be described a third prior art bandpass filter.

An interdigital bandpass filter of high frequency band, comprising quarter wave strip line resonators is known.

FIG. 9 is a perspective view of such a third prior art interdigital bandpass filter. Numerals 101 and 102 are input/output terminals. Numerals 103 to 105 are resonators formed on a dielectric substrate 106. Numerals 107 and 108 are input/output coupling lines. Numeral 109 is a ground electrode. These lines comprise strip lines or microstrip lines.

Hereinbelow will be described operation of the bandpass filter mentioned above.

A high frequency signal inputted to the input/output terminal 101 is coupled to the resonator 103 by distributed coupling. The resonators 103, 104, and 105 formed on a dielectric substrate 106 are coupled through end edges of strip lines and outputs a filtered high frequency signal at the input/output strip line 108 through coupling between the resonator 105 and the input/output strip line 108. Thus, this prior art bandpass filter provides a frequency characteristic determined by the resonance frequencies of the resonators 103. 104, and 105 and coupling characteristics, etc.

However, in the structure mentioned above, that is, in the interdigital bandpass filter, if its passband is required to be narrow, there is a problem that gaps between the resonators should be made wider, so that its size becomes large. Moreover, there are also problem in assembling and trimming because open-ends of the resonators cannot be subject to trimming because the open-ends of the resonators arranged not in the same direction.

Moreover, in the comb-line structure, there is also a problem that either coupling of electromagnetic or electrostatic couplings should be stronger than the other by providing partitions between the resonator, etc. because in the comb-line structure electromagnetic and electrostatic components have an antiphase relation.

SUMMARY OF THE INVENTION

The present invention has been developed in order to remove the above-described drawbacks inherent to the conventional bandpass filter.

According to the present invention there is provided first bandpass filter comprising: a plurality of resonators and input/output lines formed such that a strip line formed in a substantially straight line is cut in an inclined direction to the straight line to form a plurality of resonators spaced apart by gaps, the resonators being coupled across the gaps. Each of the resonators may be formed in parallelogram. Each of the resonators may be formed in a substantial isosceles triangle.

According to the present invention there is also provided a second bandpass filter comprising: a plurality of resonators and a ground electrode, each of the resonators having an open-loop strip line, one end of each of the strip line being connected to the ground electrode, width of each gaps between the resonators varying along the each of resonators to make either of electrostatic or electromagnetic coupling between the resonators stronger than the other.

According to the present invention there is further provided a third bandpass filter as mentioned in the second bandpass filter, wherein the width near the ground electrode is larger than that of other portion of the gap to make electromagnetic coupling between the resonators stronger than the electrostatic coupling between the resonators.

According to the present invention there is further provided fourth bandpass filter as mentioned in the second bandpass filter, wherein the width near the ground electrode is smaller than that of other portion of the gap to make electrostatic coupling between the resonators stronger than the electromagnetic coupling between the resonators.

According to the present invention there is also provided a fifth bandpass filter as mentioned in the second bandpass filter, wherein the strip line is formed uniformly and the resonators are radiated out from the ground electrode.

According to the present invention there is further provided a sixth bandpass filter as mentioned in the second bandpass filter, wherein the strip line is taperd.

According to the present invention there is further provided a seventh bandpass filter as mentioned in the second bandpass filter, wherein the resonators are arranged such that center lines of the resonators are in parallel to each other and are equally spaced.

According to the present invention there is further provided an eighth bandpass filter as mentioned in the second bandpass filter, wherein second width of the strip line varies stepwise.

BRIEF DESCRIPTION OF THE DRAWINGS

The object and features of the present invention will become more readily apparent from the following detailed description taken in conjunction with the accompanying drawings in which.

The same or corresponding elements or parts are designated as like references throughout the drawings.

DETAILED DESCRIPTION OF THE INVENTION

Hereinbelow will be described a first embodiment of this invention.

Figure 1:
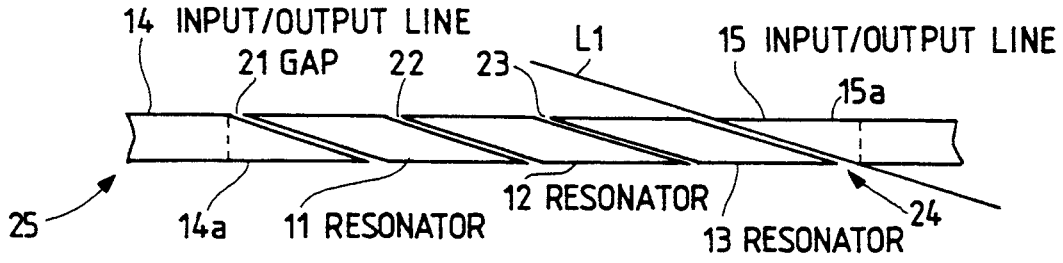
FIG. 1 is a plan view of the first embodiment of bandpass filter.

FIG. 1 is a plan view of the first embodiment of bandpass filter using electrostatic and electromagnetic coupling between side edges of strip lines. Numerals 11, 12, and 13 are cascaded resonators comprising strip lines formed in parallelograms. In this specification and claims, the term "strip line" includes strip, microstrip, and balanced strip lines. Numerals 14 and 15 are input/output strip lines having triangle portions **14*a* and 15*a* to couple to the side edges of resonators 11 and 13** respectively.

In other words, the filter of the first embodiment is formed such that a straight strip line 25 is cut by etching, etc. in the direction of an inclined line L1 to form resonators 11 to 13 separated by gaps 21 to 24.

Hereinbelow will be described operation of the first embodiment of the bandpass filter.

A high frequency signal inputted from the input/output strip line 14 is coupled to the resonator 11 by distributed coupling including electrostatic and electromagnetic couplings through side edges of the input/output strip line 14 and the resonator 11. The resonators 11, 12, and 13 are coupled through their side edges and outputs a filtered high frequency signal at the input/output strip line 15 by distributed coupling including electrostatic and electromagnetic couplings through side edges of the input/output strip line 15 and the resonator 13. The input/output strip lines 14 and 15 and the resonators 11, 12, and 13 are arranged in line, so that their total length becomes shorter because coupling is carried out by inclined side edges of triangle portions **14*a* and 15*b* and parallelogram formed resonators 11, 12, and 13**. That is, the bandpass of the first embodiment is miniaturized. Moreover, this structure provides a sufficient degree of coupling compared with electrostatic coupling between end edges because this coupling is obtained with distributed coupling between side edges of the cascaded resonators. Accordingly, there is provided a bandpass filter having a broadband and steep frequency characteristic.

Generally in the resonator having a uniform strip line, harmonic resonance frequencies occur at frequencies natural number times the fundamental frequency. However, in this bandpass filter of this embodiment, harmonic resonance occurs at lower frequencies than frequencies natural number times fundamental frequency because the strip line of the resonators are formed parallelograms. Therefore, if this resonators 11, 12, and 13 are used as the bandpass filter, the harmonic passband deviates from frequencies natural number times fundamental frequency. This characteristic provides advantage effect if this bandpass filter is used in a non-linear circuit at its output stage where harmonic waves should be suppressed.

Hereinbelow will be described a second embodiment of this invention.

Figure 2:
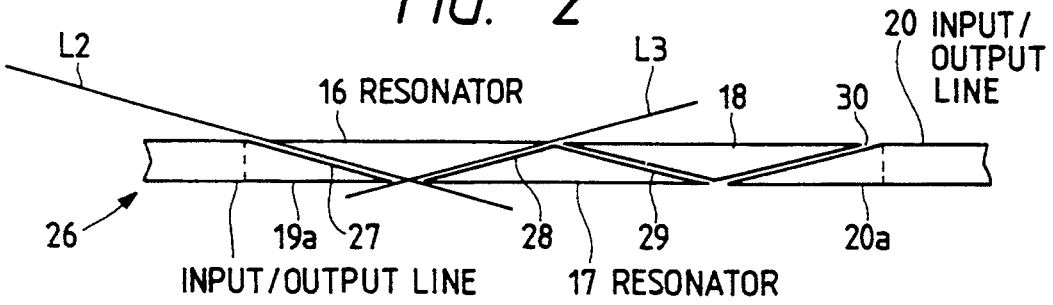
FIG. 2 is a plan view of the second embodiment of bandpass filter.

FIG. 2 is a plan view of the second embodiment of bandpass filter using electrostatic and electromagnetic coupling between side edges of strip lines. Numerals 16, 17, and 18 are cascaded resonators comprising strip lines formed in isosceles triangles. Numerals 19 and 20 are input/output strip lines having triangle portions **19*a* and 20*a* to couple to the side edges of resonators 16 and 18** respectively.

In other words, the filter of the second embodiment is formed such that a straight strip line 26 is cut by etching, etc. in the directions of inclined lines L2 and L3 to form resonators 16 to 18 separated by gaps 27 to 30.

Hereinbelow will be described operation of the second embodiment of the bandpass filter.

A high frequency signal inputted from the input/output strip line 19 is coupled to the resonator 16 by distributed coupling including electrostatic and electromagnetic couplings through side edges of the input/output strip line 19 and the resonator 16. The resonators 16, 17, and 18 are coupled through their side edges and outputs a filtered high frequency signal at the input/output strip line 20 by distributed coupling including electrostatic and electromagnetic couplings through side edges of the input/output strip line 20 and the resonator 18. The input/output strip lines 19 and 20 and the resonators 16, 17, and 18 are arranged in line, so that their total length becomes shorter because coupling is carried out by inclined side edges of triangle portions 19*a* and 20*b* and triangularly formed resonators 16, 17, and 18. That is, the bandpass of the first embodiment is miniaturized. Moreover, this structure provides sufficient degree of coupling compared with electrostatic coupling between end edges because coupling is obtained with distributed coupling between side edges of the cascaded resonators. Accordingly, there is provided a bandpass filter having a broadband and steep frequency characteristic.

Generally, in the resonator having a uniform strip line, harmonic resonance frequencies occur at frequencies natural number times the fundamental frequency. However, in this bandpass filter of this embodiment having resonators including trianglarly formed strip lines, harmonic resonance occurs at lower frequencies than frequencies natural number times fundamental frequency. Therefore, in this resonators 16, 17, and 18 are used as bandpass filter, harmonic passband frequencies deviate from frequencies natural number times fundamental frequency. This characteristic provides advantage effect if this bandpass filter of this embodiment is used in a non-linear circuit at an output stage where harmonic waves should be suppressed.

In the above mentioned embodiment, the number of the stages of the resonators in the bandpass filters are three. However, this number can be changed.

As mentioned, this invention provides bandpass filters which is miniaturized, have broadband characteristics, and have harmonic bandpass frequencies controlled because the resonators are formed in parallelograms or triangles to have a shorter dimension with linear arrangement of resonators.

Figure 3:
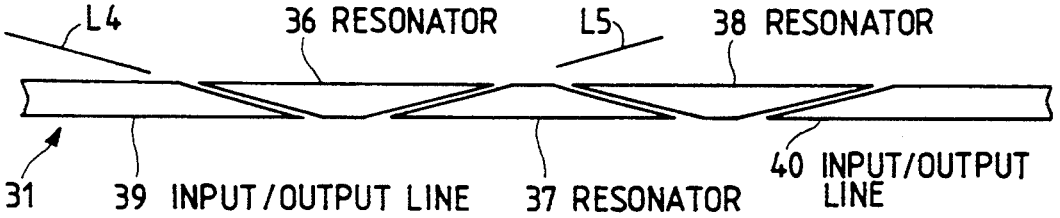
FIG. 3 is a plan view of the modified embodiment of the second embodiment of bandpass filter.
Figure 4:
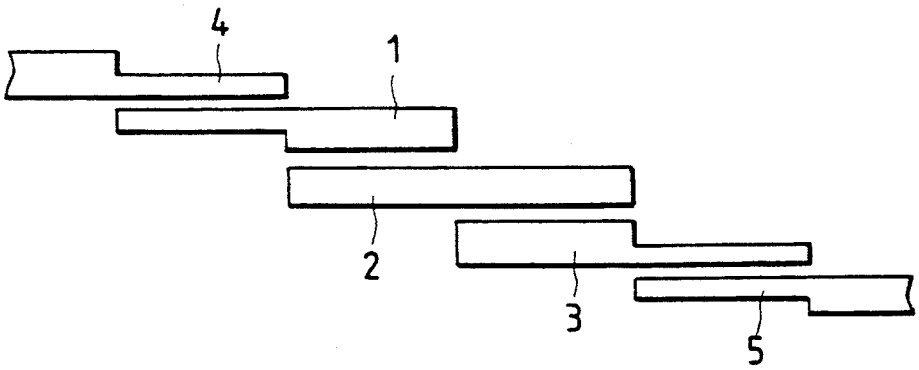
FIG. 4 PRIOR ART
FIG. 4 is a plan view of such first prior art bandpass filter.
Figure 5:
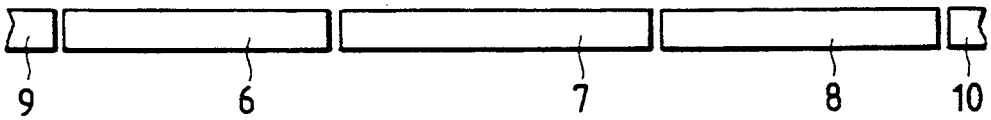
FIG. 5 PRIOR ART
FIG. 5 is a plan view of a second prior art bandpass filter.

FIG. 3 is a plan view of the modified embodiment of the second embodiment of bandpass filter using electrostatic and electromagnetic coupling between side edges of strip lines. Numerals 36, 37, and 38 are cascaded resonators comprising strip lines formed in trapezoids. Numerals 39 and 40 are input/output strip lines having triangle portions 39*a* and 40*a* to couple to the side edges of resonators 36 and 38 respectively.

In other words, the filter of this modified embodiment is formed such that a straight strip line 31 is cut by etching, etc. in the directions of inclined lines L4 and L5 to form resonators 36 to 38 separated by gaps.

Hereinbelow will be described a third embodiment.

Figure 6:
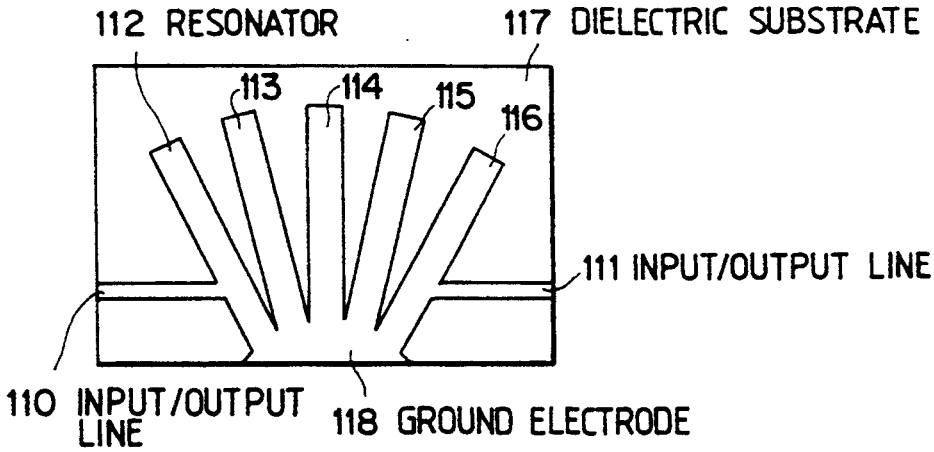
FIG. 6 is a plan view of a bandpass filter of the third embodiment.

FIG. 6 is a plan view of a bandpass filter of the third embodiment. Numeral 110 and 111 are input/output lines. Numerals 112 to 116 are resonators comprising open-end strip lines formed on a dielectric substrate 117 such that one ends of resonators 112 to 116 are connected to a ground electrode 118 and other ends are opened and spaced apart each other, that is, they are formed like a fan. The ground electrode corresponds to a hinge of the fan. The input/output line 110 is connected to the resonator 112 at a portion near the ground electrode 118. The input/output line 111 is connected to the resonator 116 at a portion near the ground electrode 118.

Hereinbelow will be described operation of the third embodiment.

Input/output coupling is obtained by tap coupling provided to the resonators 112 and 116. Coupling between the resonators 112 to 116 are provided by intervals between the resonators 112 to 116, which intervals are increased with distance from the ground electrodes 118. This structure provides a bandpass filter having a desired frequency response.

The interval near the ground electrodes 118 is small. On the other hand, the interval near the open end of the resonator 112 to 116 is made larger. Therefore, such unevenly provided gaps between the resonators 112 to 116 provides coupling between the resonators 112 to 116 because electromagnetic coupling can be made stronger than the electrostatic coupling without partitions necessary for making stronger either coupling of the electromagnetic or electrostatic coupling. Moreover, if resonance frequencies of the resonators 112 to 116 deviate from a desired frequency, the open end portion of the resonators 112 to 116 can be trimmed easily to adjust the resonance frequencies respectively because all resonator arranged in the same direction substantially.

As mentioned above, according to this embodiment, arrangement of unevenly spaced resonators 112 to 116, that is, resonators 112 to 116 arranged like a fan, makes electromagnetic coupling stronger than the electrostatic coupling, so that the coupling between the resonators 112 to 116 are provided though electric lengths of the resonators 112 to 116 are quarter wave. This provides a miniaturized comb-line bandpass filter.

Hereinbelow will be described a fourth embodiment of this invention.

Figure 7:
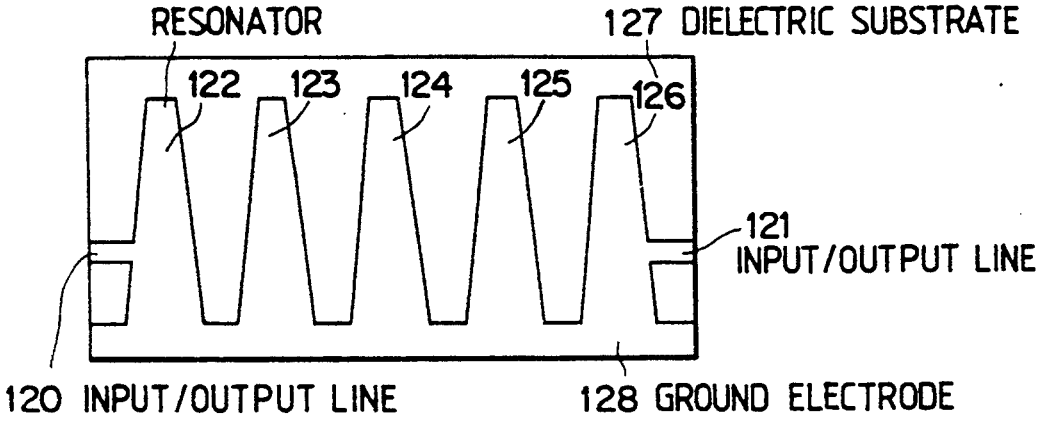
FIG. 7 is a plan view of a bandpass filter of the fourth embodiment.

FIG. 7 is a plan view of a bandpass filter of the fourth embodiment. Numeral 120 and 121 are input/output lines. Numerals 122 to 126 are resonators comprising open-loop strip lines formed on a dielectric substrate 127 such that one ends of resonators 122 to 126 are connected to a ground electrode 128 horizontally extended and other ends are opened. The resonators 122 to 126 are arranged vertically, that is, center lines thereof are equally spaced apart. Width of each of the resonators 122 to 126 decreases with distance from the ground electrode 128, that is, the resonators 122 to 126 are taperd. In other words, the bandpass filter of the fourth embodiment has a comb shape. The input/output line 120 is connected to the resonator 122 at a portion near the ground electrode 128. The input/output line 121 is connected to the resonator 126 at a portion near the ground electrode 128.

Hereinbelow will be described operation of the fourth embodiment.

Input/output coupling is obtained by tap coupling provided to the resonators 122 and 126. Coupling between the resonators 122 to 126 are provided by gaps between the resonators 122 to 126 are increased with distance from the ground electrode 128. This structure provides a bandpass filter having a desired frequency response.

The gap near the ground portion 128 is small. On the other hand, the gaps near the open ends of the resonators 122 to 126 are made larger. Therefore, such unevenly provided gaps between the resonators 122 to 126 provide coupling between the resonators 122 to 126 because electromagnetic coupling can be made stronger than the electrostatic coupling without partitions necessary for making stronger either coupling of the electromagnetic or electrostatic coupling.

Further, the resonators 122 to 126 have the width near the ground electrode 128 made wider, so that the loss in the conductor near the ground electrode where a strong high frequency current flows can be reduced, so that an unloaded Q factor becomes high. This provides a low loss bandpass filter.

Moreover, if resonance frequencies of the resonators 122 to 126 deviate from a desired frequency, the open end portion of the resonators 122 to 126 can be trimmed easily to adjust the resonance frequencies respectively because all resonator arranged in the same direction.

As mentioned above, according to this embodiment, widths of gaps between the resonators 122 to 126, increasing with distance from the ground portion 128 makes electromagnetic coupling stronger than the electrostatic coupling, so that the coupling between the resonators 122 to 126 are provided though electric lengths of the resonators 122 to 126 are quarter wave. This provides a miniaturized comb-line bandpass filter.

Hereinbelow will be described a fifth embodiment of this invention.

Figure 8:
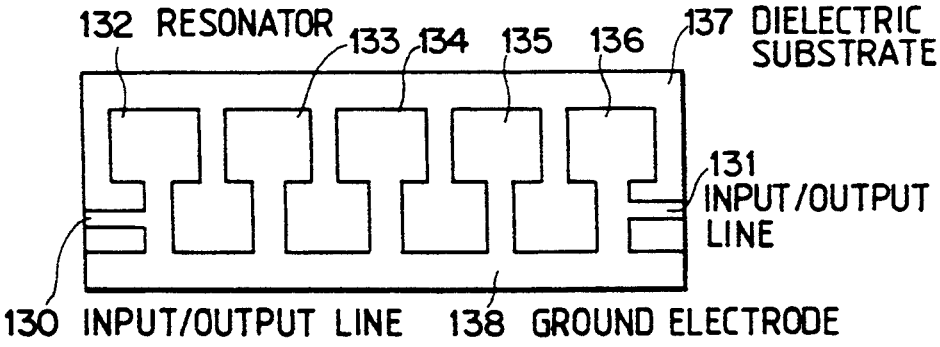
FIG. 8 is a plan view of a bandpass filter of the fifth embodiment.
Figure 9:
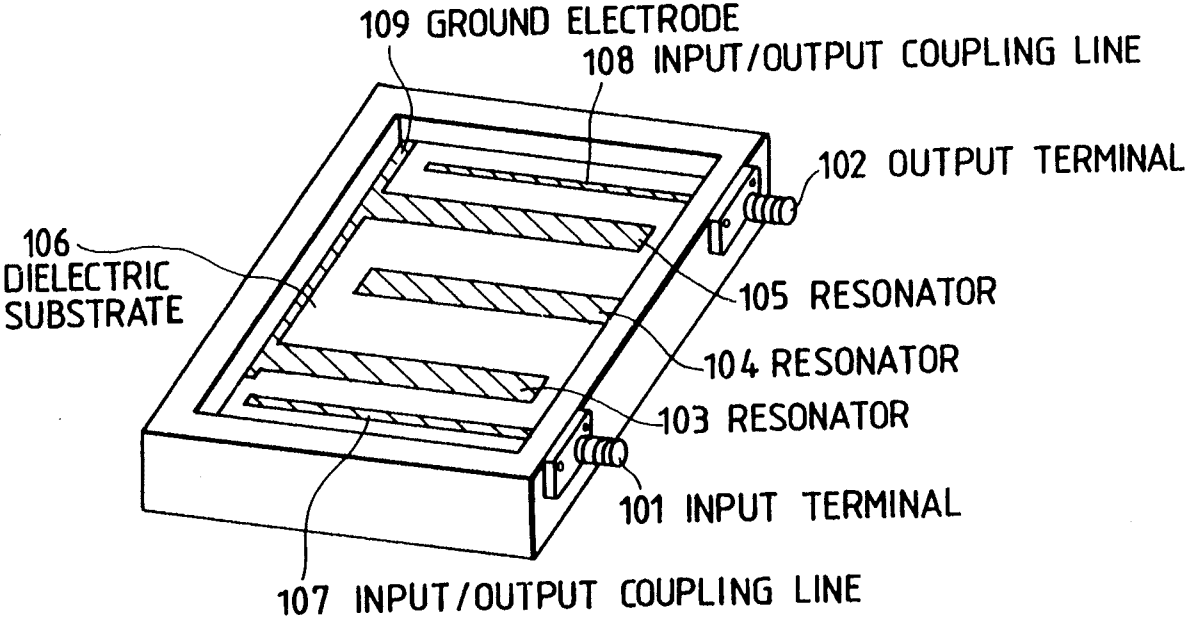
FIG. 9 PRIOR ART
FIG. 9 is a perspective view of a third prior art interdigital bandpass filter.

FIG. 8 is a plan view of a bandpass filter of the fifth embodiment. Numeral 130 and 131 are input/output lines. Numerals 132 to 136 are resonators comprising open-loop strip lines formed on a dielectric substrate 137 such that first ends of resonators 132 to 136 are connected to a ground electrode 138 horizontally extended. The resonators 132 to 136 are arranged vertically. That is, center lines thereof are in parallel each other and equally spaced apart. Width of each of the resonators 132 to 136 increases stepwise at the middle thereof, that is, a width of the first end of each resonator is larger than that of the second end. The input/output line 130 is connected to the resonator 132 at a portion near the ground electrode 138. The input/output line 131 is connected to the resonator 136 at a portion near the ground electrode 138.

Hereinbelow will be described operation of the fifth embodiment.

Input/output coupling is obtained by tap coupling provided to the resonators 132 and 136. Coupling between the resonators 132 to 136 are provided by gaps between the resonators 132 to 136. Widths of gaps between the resonators 132 to 136 are increased stepwise at the middle thereof. This structure provides a bandpass filter having a desired frequency response.

The gap near tile ground portion 138 is large. On the other hand, the gap near the open end of the resonator 132 to 136 is made small. Therefore, such unevenly formed gaps between the resonators 132 to 136 provides coupling between the resonators 122 to 126 because electrostatic coupling can be made stronger than the electromagnetic coupling without partitions necessary for making stronger either coupling of the electromagnetic or electrostatic coupling.

Moreover, if resonance frequencies of the resonators 132 to 136 deviate from a desired frequency, the open end portion of the resonators 132 to 136 can be trimmed easily to adjust the resonance frequencies respectively because all resonator arranged in the same direction.

As mentioned above, according to this embodiment, widths of gaps between the resonators 132 to 136, decreasing stepwise at the middle of the resonators 132 to 136, makes electrostatic coupling stronger than the electromagnetic coupling, so that the coupling between the resonators 132 to 136 are provided though electric lengths of the resonators 132 to 136 are quarter wave. This provides a miniaturized comb-line bandpass filter.

In the fourth embodiment, width of each of the resonators 122 to 126 increases with distance from the ground electrode, that is the resonators 122 to 126 are taperd. Coupling between the resonators 122 to 126 are provided by gaps between the resonators 122 to 126. Width of gaps are increased with distance from the ground electrode 128. However, there are possible various modified embodiments to this structure. For example, a width of each of the resonators 122 to 126 increases non-linearly. The scope of this invention includes such modified embodiments.

Similarly, in the fifth embodiment, width of each of the resonators 132 to 136 increases stepwise at the middle of tile resonators 132 to 136. However, there are possible various modified embodiments to this structure. For example, a width of each of the resonators 132 to 136 increases linearly. The scope of this invention includes such modified embodiments.

Moreover, in the third to fifth embodiments, input/output coupling is obtained by tap coupling. However, coupling can be obtained by either of electrostatic coupling or electromagnetic coupling. Further, the numbers of stage of filter, that is, the number of the resonators is assumed five in the third to fifth embodiments. However, a filter according to this invention can be realized using larger or smaller number of resonators.

What is claimed is:

1. A bandpass filter comprising:

an input strip line;

an output strip line; and a plurality of resonators formed between said input and output strip lines and formed of a plurality of conductive strip lines, said plurality of resonators being spaced apart by gaps and being coupled across said gaps, and each conductive strip line of each resonator being formed substantially in a straight line and having a pair of edges, and first and second ends with inclined edges such that the width of the conductive strip line varies at said first and second ends where coupling across the gaps occur, and said pair of edges of each conductive strip line being parallel to the straight line.

2. A bandpass filter as claimed in claim 1, wherein each conductive strip line of each resonator has a parallelogram shape.

3. A bandpass filter comprising:

a plurality of resonators formed of a plurality of strip lines said plurality of resonators being spaced apart by gaps and being coupled across said gaps, each conductive strip line of each resonator being formed substantially in a straight line and having first and second ends with first and second inclined edges, respectively, such that the width of the conductive strip line varies at first and second ends where coupling across the gaps occur, wherein said first and second inclined edges of the first and second ends have the same angle of inclination, and said first and second inclined edges incline in opposite directions.

4. A bandpass filter as claimed in claim 1, wherein each conductive strip line of each resonator has substantially a trapezoidal shape.

5. A bandpass filter comprising:

a plurality of resonators formed of open-end strip lines with inclined edges, each open-end strip line of each resonator substantially having a shape of a parallelogram, said plurality of resonators being arranged in a straight line such that pairs of parallel edges of said resonators are parallel to said straight line.

6. A bandpass filter comprising:

a plurality of resonators formed of open-end strip lines, each open-end strip line of each resonator substantially having a shape of an isosceles triangle, wherein adjacent resonators are oppositely cascaded to form a straight line; and bases of the isosceles triangle of said plurality of resonators are parallel to each other along said straight line; and each resonator is coupled through both oblique sides of the isosceles triangle.

* * * * *